US010562052B2

(12) United States Patent
Fontaine

(10) Patent No.: US 10,562,052 B2
(45) Date of Patent: Feb. 18, 2020

(54) BATTERY OPERATED BACKPACK SPRAYER

(71) Applicant: CHAPIN MANUFACTURING, INC., Batavia, NY (US)

(72) Inventor: James R. Fontaine, Marilla, NY (US)

(73) Assignee: Chapin Manufactuing, Inc., Batavia, NY (US)

( * ) Notice: Subject to any disclaimer, the term of this patent is extended or adjusted under 35 U.S.C. 154(b) by 57 days.

(21) Appl. No.: 14/817,125

(22) Filed: Aug. 3, 2015

(65) Prior Publication Data

US 2016/0038960 A1 Feb. 11, 2016

Related U.S. Application Data

(60) Provisional application No. 62/033,467, filed on Aug. 5, 2014.

(51) Int. Cl.
*B05B 9/08* (2006.01)

(52) U.S. Cl.
CPC ..... *B05B 9/0888* (2013.01); *B05B 9/0861* (2013.01); *B05B 9/0877* (2013.01)

(58) Field of Classification Search
CPC ... B05B 7/2475; B05B 7/2464; B05B 9/0413; B05B 9/0416; B05B 9/042; B05B 9/043; B05B 9/0861; B05B 9/0888; B05B 9/0877; B05B 11/3052; A01M 7/0021
USPC ..... 239/146, 152, 153, 332, 333
See application file for complete search history.

(56) References Cited

U.S. PATENT DOCUMENTS

| | | | | |
|---|---|---|---|---|
| 1,081,648 | A | 12/1913 | Adams | |
| D190,773 | S | 6/1961 | Koch | |
| D229,612 | S | 12/1973 | German | |
| 3,901,449 | A | 8/1975 | Bochmann | |
| 4,690,331 | A | 9/1987 | Luchsinger | |
| 4,702,416 | A | 10/1987 | Pagliai et al. | |
| 4,702,419 | A * | 10/1987 | Luchsinger | B05B 9/0877 239/333 |
| 4,768,714 | A | 9/1988 | Luchsinger | |
| 4,798,333 | A | 1/1989 | Luchsinger | |
| D337,368 | S | 7/1993 | Berfield et al. | |
| 5,335,853 | A | 8/1994 | Wirz | |
| 5,671,884 | A | 9/1997 | Restive | |
| 5,752,661 | A * | 5/1998 | Lewis | B05B 9/0861 222/175 |
| D406,313 | S | 3/1999 | Prosper et al. | |
| 6,412,707 | B1 | 7/2002 | Wirz | |
| 7,007,826 | B2 | 3/2006 | Shapanus et al. | |
| D527,789 | S | 9/2006 | Thompson et al. | |
| 7,104,468 | B2 | 9/2006 | Stengel | |
| 7,121,433 | B2 | 10/2006 | Nelson et al. | |

(Continued)

OTHER PUBLICATIONS

Amazon.com: Black & Decker LBXR2020-OPE 2.0 Ah Lithium Battery Pack, 20-volt, Website page printed Aug. 4, 2014.

(Continued)

*Primary Examiner* — Cody J Lieuwen
(74) *Attorney, Agent, or Firm* — Woods Oviatt Gilman LLP; Katherine H. McGuire, Esq.

(57) ABSTRACT

A battery operated backpack sprayer is provided where the battery is releasably mounted under a housing attached to the tank of the sprayer. At the bottom of the housing is a receptacle for the battery and from which the battery can be released for recharging or replacement.

17 Claims, 5 Drawing Sheets

(56) References Cited

U.S. PATENT DOCUMENTS

| | | | | |
|---|---|---|---|---|
| 7,134,612 | B2 | 11/2006 | Bertucci et al. | |
| 7,207,500 | B2 | 4/2007 | Hudson et al. | |
| D547,416 | S | 7/2007 | Hillhouse | |
| 7,318,539 | B2 | 1/2008 | Vitantonio et al. | |
| D567,897 | S | 4/2008 | Hillhouse | |
| 7,350,723 | B2 * | 4/2008 | Reedy | B05B 7/2416 239/296 |
| D570,447 | S | 6/2008 | Hillhouse | |
| D582,000 | S | 12/2008 | Campbell | |
| D590,043 | S | 4/2009 | Campbell | |
| D591,387 | S | 4/2009 | Campbell | |
| D594,087 | S | 6/2009 | Campbell | |
| 7,554,290 | B2 | 6/2009 | Johnson et al. | |
| D604,386 | S | 11/2009 | Campbell | |
| D609,773 | S | 2/2010 | Abernethy | |
| D616,959 | S | 6/2010 | Wu | |
| D618,300 | S | 6/2010 | Hudson | |
| 7,789,329 | B2 | 9/2010 | Klein | |
| 7,854,396 | B2 | 12/2010 | Wu | |
| D633,984 | S | 3/2011 | Plantz | |
| D639,388 | S | 6/2011 | Plantz | |
| D660,942 | S | 5/2012 | Hudson | |
| D664,236 | S | 7/2012 | Hudson | |
| D669,965 | S | 10/2012 | Fontaine | |
| D670,788 | S | 11/2012 | Plantz | |
| 8,312,937 | B2 | 11/2012 | Turner et al. | |
| D672,848 | S | 12/2012 | Wirz | |
| D685,057 | S | 6/2013 | Wirz | |
| 8,596,555 | B2 | 12/2013 | Thompson et al. | |
| 8,616,466 | B2 | 12/2013 | Strauss | |
| 8,672,364 | B2 | 3/2014 | Schrum et al. | |
| D719,637 | S | 12/2014 | Pagliai | |
| D719,638 | S | 12/2014 | Pagliai | |
| D719,639 | S | 12/2014 | Pagliai | |
| D721,161 | S | 1/2015 | Yam | |
| D725,742 | S | 3/2015 | Kennemer et al. | |
| D731,027 | S | 6/2015 | Sanz Perez | |
| 2003/0140507 | A1 * | 7/2003 | Lagaly | B23D 49/162 30/392 |
| 2005/0006400 | A1 * | 1/2005 | Shapanus | B05B 9/0861 222/1 |
| 2006/0013709 | A1 | 1/2006 | Hudson et al. | |
| 2009/0152382 | A1 * | 6/2009 | Charpie | B05B 7/2478 239/526 |
| 2009/0173753 | A1 * | 7/2009 | Conner | B05B 9/007 222/333 |
| 2009/0242598 | A1 * | 10/2009 | Dormaar | A45F 3/14 224/257 |
| 2011/0057436 | A1 * | 3/2011 | Schrum | B05B 9/0406 285/33 |
| 2011/0198413 | A1 * | 8/2011 | Thompson | B05B 9/01 239/322 |
| 2012/0241014 | A1 * | 9/2012 | Wise | F04B 17/06 137/13 |

OTHER PUBLICATIONS

Chapin International, Inc., Chapin Retail Sprayer Catalog, pp. 1-3, at least as early as Jul. 31, 2014.

Solo, Online Troubleshooting/Resource Center, Website page at http://www.solousa.com/support/kbase/topic.php?id=20 , printed Mar. 29, 2006.

* cited by examiner

BATTERY OPERATED BACKPACK SPRAYER

Priority is claimed to U.S. Provisional Patent Application Ser. No. 62/033,467, filed Aug. 5, 2014, which is herein incorporated by reference.

DESCRIPTION

The present invention relates to battery powered backpack sprayers and particularly to a mounting for a battery attached together with an electric motor driven pump assembly to the tank of the sprayer at the bottom thereof.

Backpack sprayers have been provided using crank mechanisms for driving the pump which is attached to the tank of the sprayer. Such sprayers are illustrated in U.S. Patents including Klein, U.S. Pat. No. 7,789,329 issued Sep. 7, 2010; which cites other patents namely Wirz, U.S. Pat. No. 5,335,853 issued Aug. 9, 1994; and Wirz, U.S. Pat. No. 6,412,707 issued Jul. 2, 2002; also Luchsinger U.S. Pat. No. 4,768,714 issued Sep. 6, 1988 and Luchsinger U.S. Pat. No. 4,798,333 issued Jan. 17, 1988. In these patents, a manually operated crank mechanism is provided for reciprocating the pump attached to a sprayer tank to pressurize a pressure chamber in the tank which supplies pressurized liquid for spraying through an outlet hose and nozzle. It has been proposed to utilize an electric motor driven pump in a backpack sprayer, instead of a crank driven pump, for pressurizing liquid for spraying. An electric motor driven, battery operated pump have the mounting for the battery internal of the tank of the sprayer is shown in Hudson et al., U.S. Pat. No. 7,207,500 issued Apr. 24, 2007; or in a specially designed battery receptacle in the tank as shown in Shapanus et al., U.S. Pat. No. 7,007,826 issued Mar. 7, 2006.

The present invention provides a sprayer having an improved mounting for the battery which powers the electric motorized pump of the sprayer, which makes the battery readily accessible for removal for recharging or replacement. Another advantage for the sprayer having the improved mounting for the battery is that it may be incorporated using the same tank and internals of the tank as are used in existing crank operated sprayers, for example as shown in the Klein U.S. patent referenced above or in backpack sprayers sold by Chapin Manufacturing, Inc. and others; making it unnecessary to redesign the tank and the attachments of the pump thereto. Nevertheless the entire pump and battery unit can be releasably connected to the tank and the whole unit does not have to be disconnected from the tank in order to have access to the battery for recharging or replacement.

Briefly described, the present invention embodies a battery operated backpack sprayer having a housing which is mounted, for example to a collar, at the bottom of the tank of the sprayer by a clamp mechanism. A motor and pump assembly can be attached to the flange at the bottom of the pressure chamber used in existing backpack sprayers; for example the flanged pressure chamber (shown in the above cited Klein U.S. Patent). The housing is provided at the bottom thereof with a receptacle for removably receiving a battery which powers the motor pump assembly, and into which receptacle the battery may readily be inserted and from which the battery can be removed for recharging or replacement. The housing has wiring from a connector in the receptacle to the motor of the motor-pump assembly in the housing. The connector connects to contacts of the battery when inserted in the receptacle.

Optionally, the pressure chamber need not be provided, and may be replaced merely by a member similar to the flange, which enables the housing to be clamped to the bottom of the tank as well as providing an attachment for the motor-pump assembly.

The foregoing and other features, objects and advantages of the invention will become more apparent from a reading of the following description in connection with the accompanying drawings in which.

Figure 2:
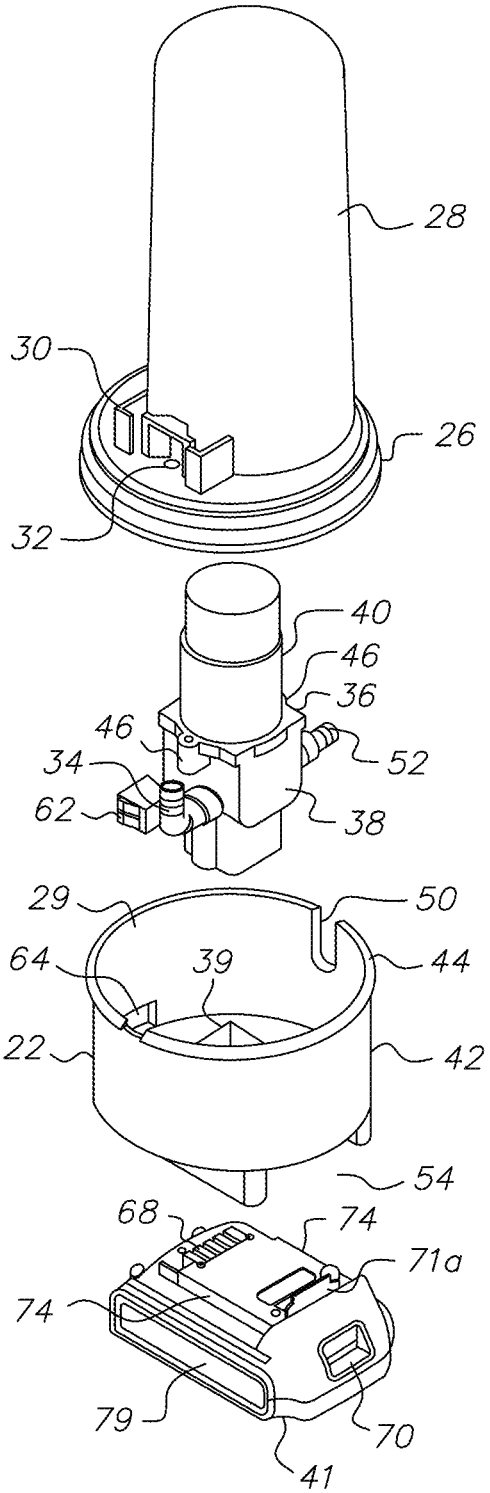
FIG. 2 is an exploded perspective view showing the battery and other parts of the mounting which encloses the lower portion of the motor-pump assembly and is attached to the flange of the pressure chamber which is inserted in the tank of the sprayer.
Figure 2A:
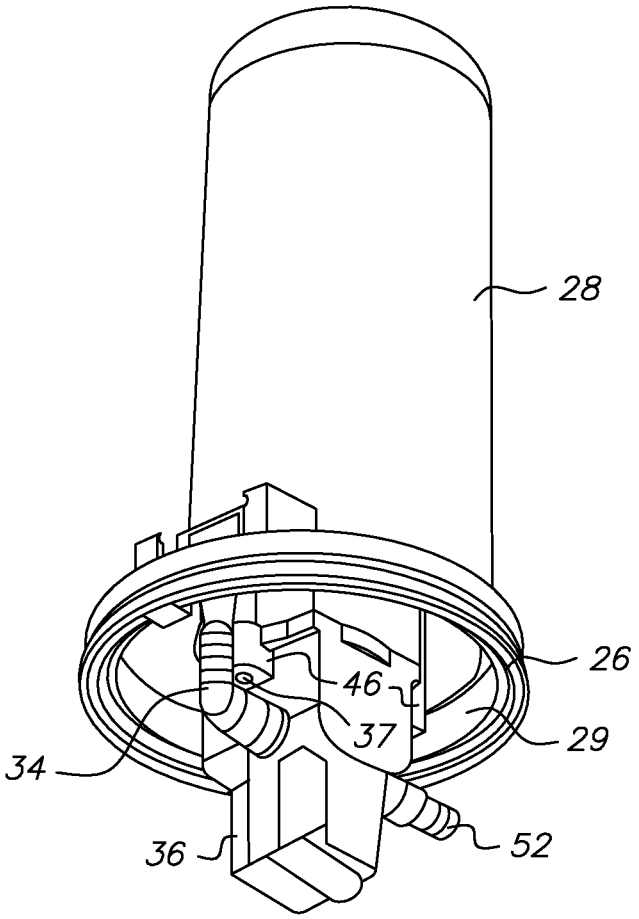
FIG. 2A is an perspective view, from the bottom thereof, of the motor-pump assembly of FIG. 2 when attached to the flange of the pressure chamber, where the battery and the cup-shaped housing of the battery mounting is removed.
Figure 2B:
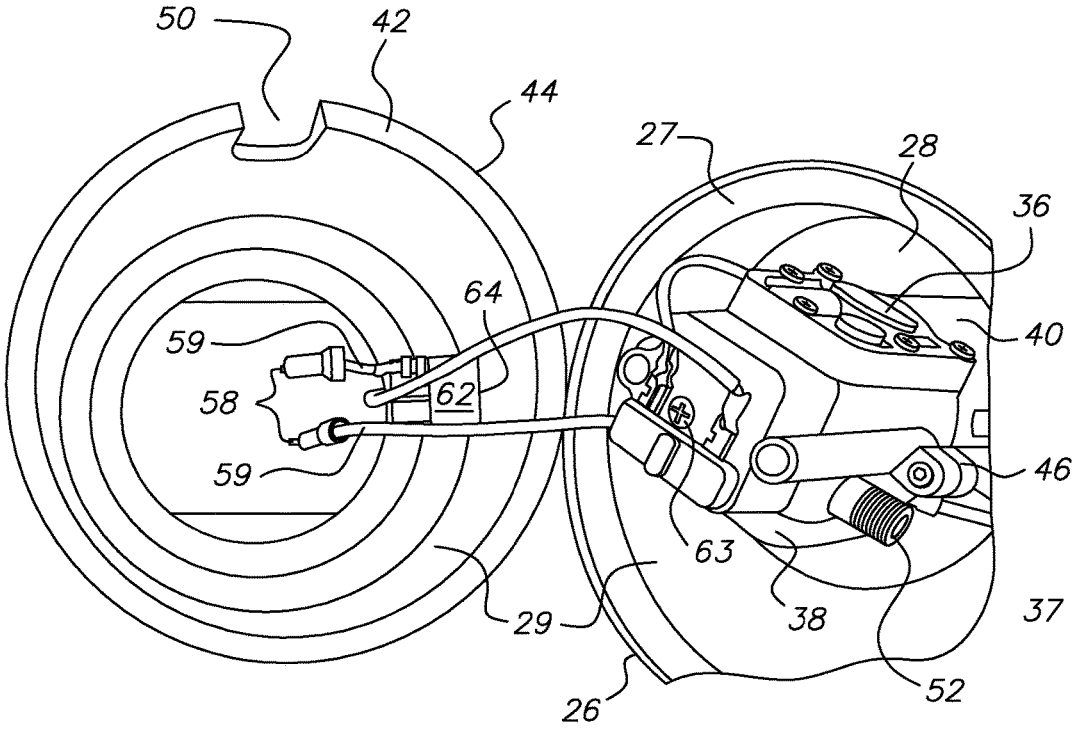
Figure 3:
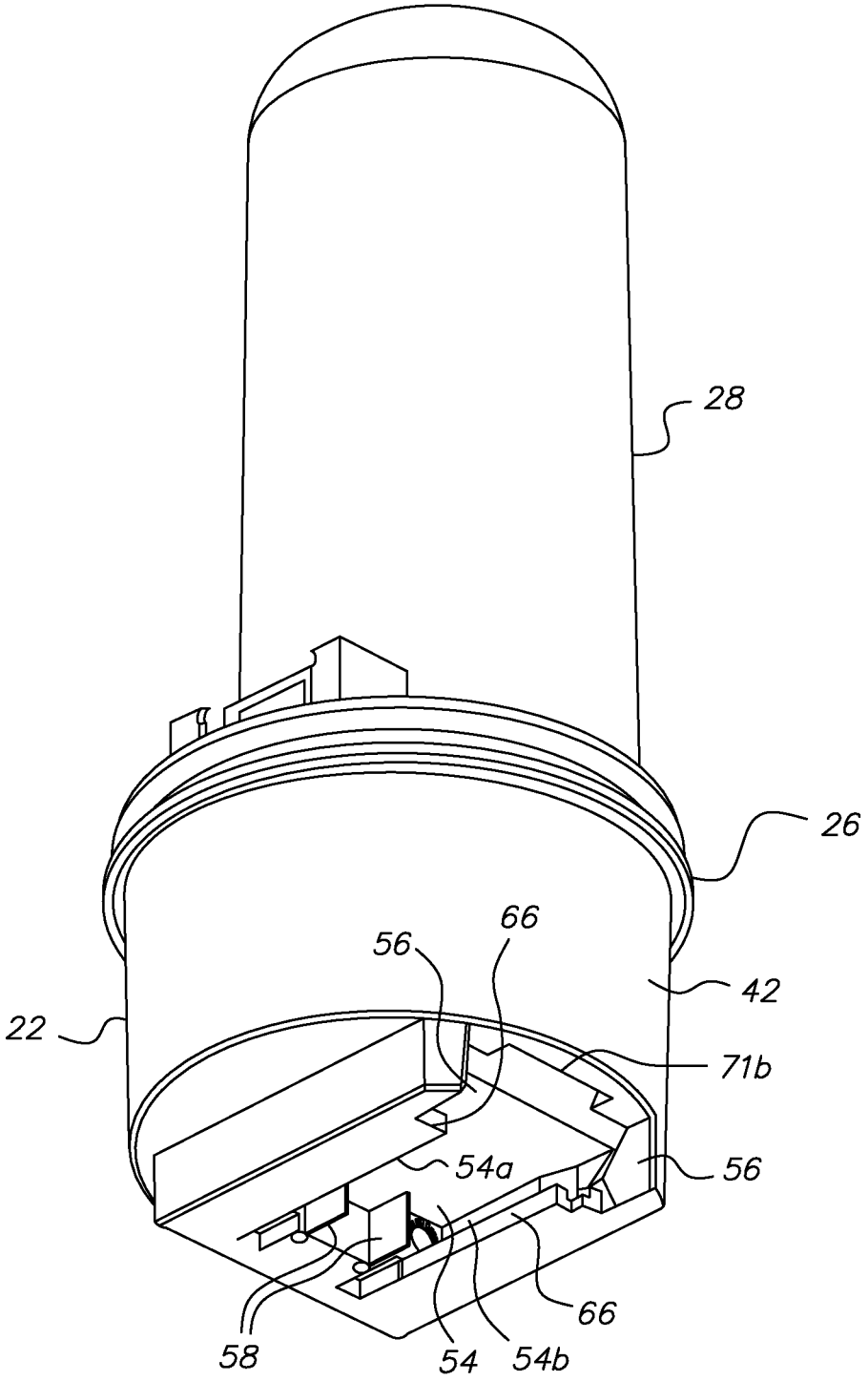

FIG. 2B is a partial, perspective view of the interior of the cup-shaped housing of the battery mounting of FIG. 2 and flange of the pressure chamber when detached from each other, so as to illustrate wires providing electrical connection between the connector along the housing and the motor-pump assembly; and FIG. 3 is a perspective view from the bottom of the mounting for the battery, from which the battery is removed to illustrate the receptacle which releasably contains the battery.

Referring more particularly to the figures, there is shown a tank 10 of a backpack sprayer 12. At the top of tank 10 is a tank filling opening closed by a cap 14 in which liquid to be pumped is poured and contained in the tank 10. A bracket 16 is attached to tank 10 on legs 18 which extend from the tank. The bracket may be curved at 20. The straps attaching the bracket to the person operating the sprayer are not shown for the sake of simplicity and may be of the kind of straps which are in use with backpack sprayers.

A mounting 22 for a battery 41 is provided, which is attached to a collar 24 providing an opening and extending from the bottom of tank 10. Located inside the collar 24 is a support member which is provided by the flange 26 of a pressure chamber 28 (see especially, FIG. 2).

A motor-pump assembly 36 is attached to and supported by the flange 26. The flanged pressure chamber 28 is the same design as described in the earlier cited Klein U.S. Patent, and includes a filter receiving receptacle 30, behind which is an opening 32, through the flange 26, which by tubing (not shown) is connected to an inlet (or inlet tube) 34 of the motor-pump assembly 36. As shown in FIG. 2A, motor-pump assembly 36 is attached by two screws 37 (only one screw 37 is shown for purposes of illustration) extending through features 46, through which the screws may pass and captured in threaded holes in the flange 26. Screws 37 may also couple the upper and lower portions of the motor-pump assembly 36 together before the screws 37 extend into flange 26 and fix motor-pump assembly 36 to flange 26. The upper portion of the motor-pump assembly 36 extends through an opening in flange 26 into chamber 28 (as best shown in in FIG. 2B), while the lower portion of motor-pump assembly 36 extends below chamber 28 (as best shown in FIG. 2A) into a cup-shaped housing 42. Such housing 42 may have an opening or recess 39 shaped complementary to the shape of the bottom of the motor-pump assembly 36 for locating the lower portion of such motor-pump assembly 36 inside of a chamber 29 in housing 42.

Liquid to be sprayed from the tank 10 is received and pressurized by the pump 38 part of the motor-pump assembly 36. An outlet (or outlet tube) 52 provides a discharge of fluid from pump 38. The pump's motor 40 of the motor-pump assembly 36 preferably is a DC (direct current) motor, which is powered by the battery 41. Pump 38 thus may be considered an electric motor 40 driven pump powered by such battery 41.

The earlier described mounting 22 for the battery 41 is provided by cup-shaped housing 42. Housing 42 has a rim 44 along its open end which aligns with flange 26 along interior edge 27 (FIG. 2B) of flange 26 so that motor-pump assembly 36 when fixed to flange 26 is contained within a cavity or chamber 29 formed by the cup-shaped housing 42, flange 26, and part of the pressure chamber 28 extending above its flange 26. The housing 42 is clamped at its rim 44 to the collar 24 by means of a clamp ring 76 which is tightened and loosened by a bolt 78 as described in the earlier cited Klein U.S. patent. The clamp ring 76 also attaches the flange 26 to the bottom of the tank 10 as by clamping onto the collar 24. The outlet 52 of the pump 38 passes through a notch 50 in the housing 42.

In operation, the battery 41 provides the power for operating the motor 40, actuating the pump 38 so as to draw liquid from the tank through the inlet 34 and provide pressurized liquid out of the outlet 52. The outlet 52 provides a coupling connected to the hose and nozzle (not shown) of the sprayer 12.

The pump 38 may be a diaphragm pump of known design, having a flexible diaphragm and a pair of check (one-way) valves. One check valve is associated with the inlet 34 and the other check valve is associated with the outlet 52. The diaphragm is flexed cyclically by a cam mechanism, which may be an elliptically shaped disk rotated by the motor 40. When flexed in one direction, the diaphragm is on the suction part of its cycle, liquid from the tank is sucked into the diaphragm pump because the check valve connected to the inlet 34 is open while the other check valve connected to the outlet 52 is closed. Conversely on the pressure part of the cycle, the check valve connected to the outlet 52 is opened and the check valve for the inlet 34 is closed, thereby sending pressurized liquid through the outlet 52 to the hose and nozzle of the sprayer for spraying.

The motor 40 is connected via leads or wires 59 (FIG. 2B) to a connector 58 inside a receptacle 54 (see FIG. 3). The receptacle 54 is sufficiently deep to accept battery 41 from an end 56, shown at the right in FIG. 3. The connector 58 is shown having two prongs or contacts for connecting or mating with battery contacts 68 when the battery is received in receptacle 54.

The connector 58 is connected by wires 59 inside the housing 42 to the motor-pump assembly 36 for powering the motor 40 with current provided by the battery 41. These wires 59 connect to a switch 62 located in an opening 64 (FIGS. 1, 2 and 2B) in the wall of the housing 42 to turn the motor 40 operating the pump 38 of the sprayer on or off by the operator, thereby enabling or disabling power to the motor 40, respectively. As shown in FIG. 2B, one of the wires 59 connects one contact of connector 58 via switch 62 to a positive terminal of motor-pump assembly 36, while the other of wires 59 connects the other contact of connector 58 to a negative terminal of the motor-pump assembly 36. The motor-pump assembly 36 is preferably a demand pumping system and also preferably has an internal pressure switch which disables power to the motor when fluid pressure in the pump 38 exceeds a threshold level, which is adjustable by a set screw 63. When fluid pressure in the pump 38 no longer exceeds such level, power is restored to the motor 40 if switch 62 is in its on position. Other pump-motor units than assembly 36 shown may be utilized, which may have other electrical connections to power and operate the motor in such unit.

Rails 66 inside two opposing walls 54*a* and 54*b* of the receptacle 54 guide battery 41 along its opposing surfaces 74 (FIG. 2) into the receptacle 54 so that connections are made from contacts 68 on the battery 41 to the connector 58 inside the receptacle 54. A latch mechanism is provided in the receptacle 54 which catches the battery 41 once fully inserted along rails 66 and connected at connector 58. For example, such latch mechanism may have a spring-loaded latch member 71*a* (FIG. 2) which is received along slot or ledge 71*b* of receptacle 54 (FIG. 3) when battery 41 is fully inserted in receptacle 54. Such latch member 71*a* is coupled to a release button 70 which when pressed pushes latch member 71*a* away from its engagement with slot or ledge 71*b*, and allows the battery 41 to be released from the receptacle 54 for removal for recharging or replacement.

The battery 41 for example may be a commercially available battery, such as a lithium-ion battery model LBXR20 available from Black & Decker Company of Towson Md., USA, can be removably inserted along rails 66 and contained in the receptacle 54 at the bottom of the cup-shaped housing 42. The releasable battery latch mechanism in receptacle 54 may cooperate with its connector 58 of the receptacle which connects to the contacts 68 of battery 41. The latch mechanism may be defined by the manufacturer of the battery and may be similar to those used in different battery operated products that accept such battery. Other rechargeable batteries may be used and adapted to be releasably held in receptacle 54 for providing power to motor 40.

Figure 1:
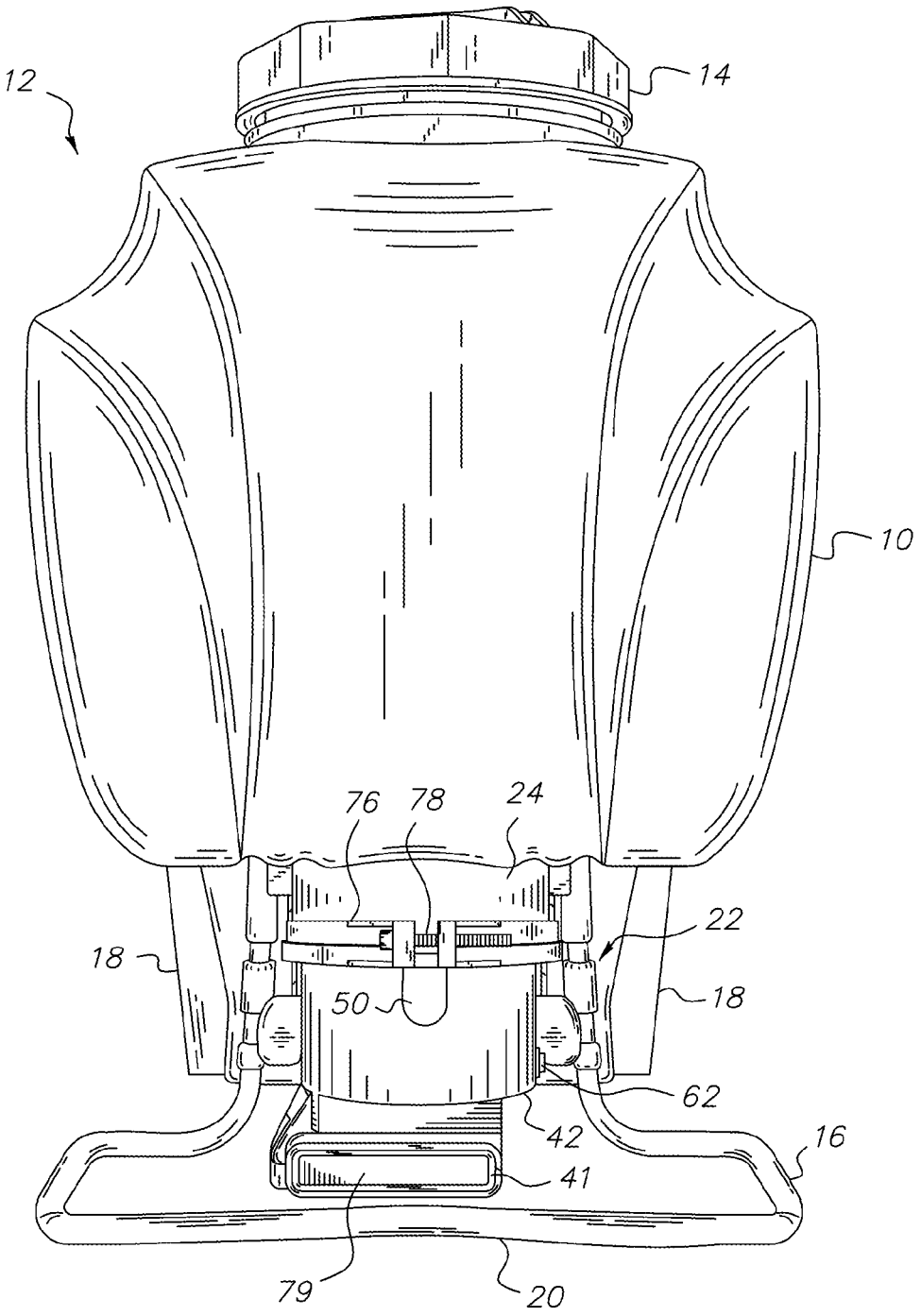
FIG. 1 is a perspective, elevational view of a backpack sprayer, which is battery operated, all in accordance with the invention; the hoses and nozzles which are attached to the sprayer having been removed since they are not necessary to the understanding of the invention and are not part of the invention.

Since the receptacle 54 is at the bottom of the housing 42, and the housing 42 is external to the tank 10, the battery 41 is readily accessible to the operator for recharging or replacement. As shown in FIGS. 1 and 2, the battery 41 is contained only on the top half thereof in the receptacle 54. The identification of the battery may be provide on the side thereof in the space 79 visible to the user.

The pressure chamber 28 shown in FIGS. 2, 2A, and 3 is not utilized for pressuring fluid from tank 10, but included to illustrate ease of retrofit of a manually pumped backpack sprayers, such as sold by Chapin Manufacturing, Inc. and others, to be battery operated using motor-pump assembly 36 in housing 42. If desired, pressure chamber 28 may be replaced by a support member similar to flange 26 that both provides for attachment for motor-pump assembly 36 and enables housing 42 to be coupled to tank 10 at its bottom collar 24, where such collar provides an opening into the tank into which the support member is situated.

From the foregoing description it will be apparent that there has been provided an improved backpack sprayer which is battery driven with a battery removably received in a receptacle of a mounting housing disposed at the bottom of the tank of the sprayer to provide convenient access to the battery for insertion and for replacement as required in the operation of the sprayer. Variations and modifications of the improved backpack sprayer within the scope of the invention will undoubtedly suggest themselves to those skilled in the art. Accordingly the description should be taken as illustrative and not in a limiting sense.

The invention claimed is:

1. A sprayer comprising:

a tank having a bottom opening;

a chamber extending into said bottom opening;

a housing having a bottom, the housing coupled to said chamber to define a cavity therebetween;

an electric motor driven pump unit comprising an electric motor and a pump, wherein the housing encloses at least a lower portion of the electric motor driven pump unit and the tank encloses at least an upper portion of the electric motor driven pump unit, whereby the electric motor driven pump unit resides entirely within said cavity;

a battery which electrically powers said pump; and a receptacle at the bottom of the housing for releasably receiving said battery, said battery being externally disposed below a lowest portion of the housing opposite said tank when received in said receptacle.

2. The sprayer according to claim 1 wherein said housing is cup-shaped with an open top, and with said bottom of said housing for mounting said receptacle.

3. The sprayer according to claim 1 further comprising:

a support member which depends from said tank and is attached to said electric motor driven pump unit;

a clamp attaching said housing at a top thereof to said support member, wherein said clamp also attaches said housing to said bottom opening of said tank with said electric motor driven pump unit disposed inside said housing; and connectors in said receptacle connecting said battery to electrically power said pump when said battery is received in said receptacle.

4. The sprayer according to claim 3 wherein said tank has a collar at the bottom opening thereof, said collar having a flange, in which said collar and said flange define said support member, said clamp being a ring disposed around a rim of said flange for releasably attaching said housing with said electric motor driven pump unit therein to the bottom opening of the tank.

5. The sprayer according to claim 4 wherein said support member extends from a base of said chamber locatable in said tank, said upper portion of said electric motor driven pump unit is received in said chamber when said lower portion of said electric motor driven pump unit is received in said housing.

6. The sprayer according to claim 3 wherein said bottom of said housing has an internal recess which is shaped complementary to the electric motor driven pump unit for receiving at least part of the electric motor driven pump unit thereby locating and aligning the electric motor driven pump unit in said housing.

7. The sprayer according to claim 6 wherein said support member has a structural feature to which said electric motor driven pump unit is attached when aligned in said housing by said internal recess.

8. The sprayer according to claim 1 further comprising an on-off switch for controlling power to said electric motor driven pump unit, said switch being mounted on said housing.

9. The sprayer according to claim 1 further comprising a bracket extending below said tank and adjacent to said housing, said tank being configured to be carried by an operator against the back of said operator, said bracket supporting said tank, said electric motor driven pump unit, and said battery all depending below said tank to provide a backpack sprayer.

10. The sprayer according to claim 1 further comprising a flange along said chamber which is clamped to a rim along an open end of said housing to fix both said housing to said chamber and said housing to said tank when said chamber is located along said opening of said tank.

11. The sprayer according to claim 1 wherein said receptacle comprises two opposing rails extending below and along the bottom of said housing to guide said battery in said receptacle to an electrical connection with said electric motor driven pump unit.

12. The sprayer according to claim 11 wherein said receptacle further comprises means for releasably retaining said battery when received in said receptacle below said housing.

13. A sprayer comprising:

a tank having a bottom opening along a collar;

a unit having a pump and a motor for electrically driving said pump;

a chamber extending into said tank via said bottom opening of said tank and having a lower flange locatable along said collar, in which said chamber contains at least a portion of said motor;

a cup shaped housing having an open top end aligned with said flange, in which said housing contains at least a portion of said pump, wherein the unit resides entirely within said chamber and said housing;

a battery which electrically powers said pump via electrical connection to said motor of said unit;

an externally accessible receptacle under the housing opposite said tank for releasably receiving said battery, said battery being externally disposed below a lowest portion of said housing when received in said receptacle; and a clamp for clamping said housing by said flange to said collar with said chamber inserted into said tank along said bottom opening.

14. The sprayer according to claim 13 wherein said tank is part of a backpack sprayer.

15. The sprayer according to claim 13 wherein said receptacle has rails for receiving said battery and a latch member for releasably retaining said battery in said receptacle.

16. The sprayer according to claim 13 wherein said unit extends from said housing upwards into said bottom opening and said collar.

17. A sprayer comprising:

a tank with a bottom opening and a top;

a chamber extending into said bottom opening;

a housing having a bottom, the housing coupled to said chamber to define a cavity therebetween;

an electric motor driven pump unit comprising an electric motor and a pump, said electric motor driven pump unit having upper and lower portions, wherein said lower portion of said electric motor driven pump unit resides in said housing and includes an inlet for receiving fluid from said tank, and said upper portion of said electric motor driven pump unit extends through the bottom opening of the tank and resides within said chamber, wherein the electric motor driven pump unit resides entirely within said cavity;

tubing through which fluid from said tank may pass to said inlet, wherein said tubing extends from said inlet separate from said upper portion of said electric motor driven pump unit; and a receptacle at said bottom of said housing for releasably receiving a battery which electrically powers said electric motor driven pump unit.

* * * * *